United States Patent [19]

Anahara et al.

[11] Patent Number: 4,485,528

[45] Date of Patent: Dec. 4, 1984

[54] METHOD AND APPARATUS FOR DRAFTING FIBER STRANDS

[75] Inventors: Meiji Anahara, Kariya; Yoshihisa Suzuki, Chiryu, both of Japan

[73] Assignee: Kabushiki Kaisha Toyoda Jidoshokki Seisakusho, Aichi, Japan

[21] Appl. No.: 406,782

[22] Filed: Aug. 10, 1982

[30] Foreign Application Priority Data

Aug. 15, 1981 [JP] Japan ..... 56-127994

[51] Int. Cl.[3] ..... D06H 3/08

[52] U.S. Cl. ..... 19/258; 19/288

[58] Field of Search ..... 19/244, 258, 288

[56] References Cited

U.S. PATENT DOCUMENTS 2,856,643 10/1958 Spencer ..... 19/258 X 4,372,010 2/1983 Gauvain ..... 19/288 X

FOREIGN PATENT DOCUMENTS 3036697 4/1981 Fed. Rep. of Germany ..... 19/288

*Primary Examiner*—Louis Rimrodt

*Attorney, Agent, or Firm*—Burgess, Ryan & Wayne

[57] ABSTRACT

A fiber strand delivered to a draft zone between a pair of back rollers and a pair of front rollers is introduced into a passage formed through a fiber strand guide device. On the way of the passage, floating fibers contained in the fiber strand are controlled by means of a fluid stream jetted to a back surface of the fiber strand to press the fiber strand onto an inner wall of the passage as well as forward it towards the front rollers. A pressing plate may be cooperatively utilized with the fluid stream. Accordingly regular drafting is attained.

15 Claims, 7 Drawing Figures

METHOD AND APPARATUS FOR DRAFTING FIBER STRANDS

BACKGROUND OF THE INVENTION

1. Field of the Invention

The present invention relates to an improvement in a method and apparatus for drafting a fiber strand by draft means comprising at least two pairs of parallelly arranged rollers, utilized in a ring spinning frame, a fasciated yarn spinning frame or the like.

2. Description of the Prior Art

Ordinarily, the drafting operation is performed by supplying a fiber strand between a pair of top and bottom back rollers and a pair of similar front rollers rotated at a speed higher than the former and reducing the thickness of the fiber strand due to the difference of speeds of the two pairs of the rollers. In this operation, the presence of so-called floating fibers which are not nipped by any of the two pairs of the rollers becomes a problem. Since the floating fibers behave in a very unstable manner at the drafting operation, it is necessary to control the floating fibers to perform a good drafting operation. According to the conventional technique, there has widely and effectively been adopted a so-called Casablanca system for controlling floating fibers, in which a pair of endless aprons are disposed in the midway between a pair of back rollers and a pair of front rollers so that the aprons softly grip a fiber strand delivered from the back rollers and convey it to the front rollers. This system, however, is disadvantageous because the apron is readily damaged due to frequent bending with a small radius of curvature during the operation, and scratches by fibers wound on the apron. This disadvantage is conspicuous in case of a high speed operation, and when the delivery speed is as high as 150 m/min, the apron is broken if the operation is continued for about one month, and the system is not preferred from the practical viewpoint.

SUMMARY OF THE INVENTION

It is a primary object of the present invention to provide a system in which an effect similar to the effect attainable by the Casablanca system can be attained by controlling a fiber strand in the drafting zone by using a fluid such as air and a stationary member without using an element that is readily broken, such as an apron, and which is superior to the Casablanca system in durability.

Another object of the present invention is to provide a draft control system which is suitably applied to a fasciated yarn spinning machine or ring spinning frame.

More specifically, in accordance with the present invention, there is provided a system in which a fiber strand is introduced into a fiber strand guide device comprising a passage having a substantially tubular inner wall, which is disposed between back rollers and front rollers, a fluid having a component of force exerted in the running direction of the fiber strand is applied on the fiber strand run through said passage so that the fiber strand is pressed to and contacted with a part of the inner wall of said passage. Furthermore, modifications of this system are provided according to the present invention.

The present invention will now be described in detail with reference to the accompanying drawings.

DETAILED DESCRIPTION OF THE PREFERRED EMBODIMENTS

Figure 1:
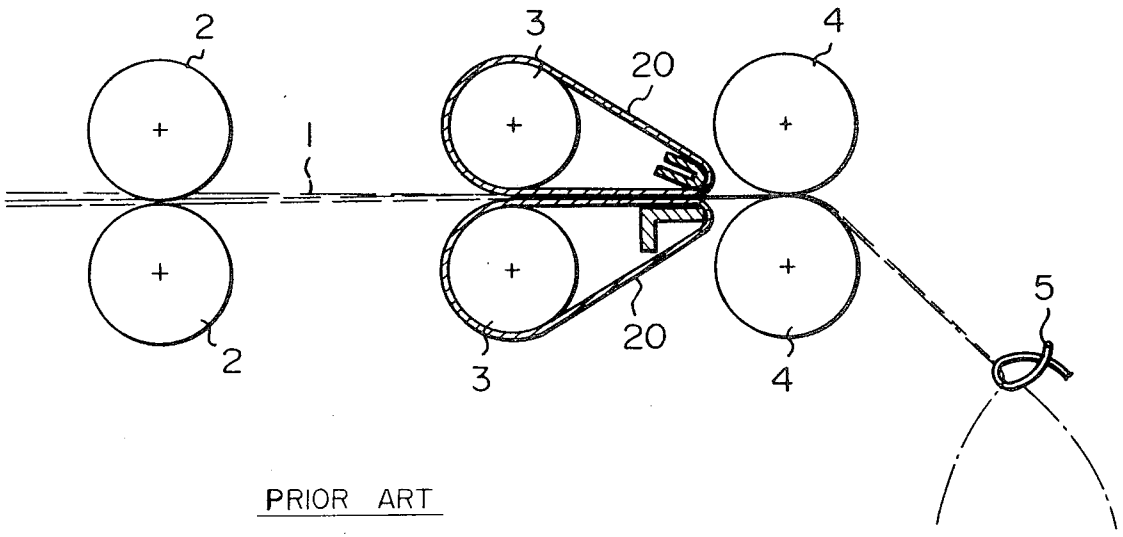
Fig. 1 PRIOR ART
FIG. 1 is a sectional side view diagrammatically illustrating the conventional drafting mechanism of the Casablanca system.

Referring to FIG. 1 diagrammatically illustrating a draft control apparatus provided with aprons of the Casablanca system, a fiber strand 1 is successively drafted between a pair of first back rollers 2 and a pair of second back rollers 3 and between a pair of the second back rollers and a pair of front rollers, and the fiber strand having a predetermined reduced size is delivered out from the front rollers 4 and wound on a bobbin (not shown) in the form of a package through a snail wire 5 while being twisted. Draft performed between two pairs of back rollers 2 and 3 is so-called break draft of a low draft ratio, and the fiber strand is substantially drafted between second back rollers 3 and front rollers 4. Accordingly, the above-mentioned control of floating fibers should be performed in this substantial drafting zone. For attaining this purpose, a pair of aprons 20 wound on second back rollers 3 are arranged.

Figure 2:
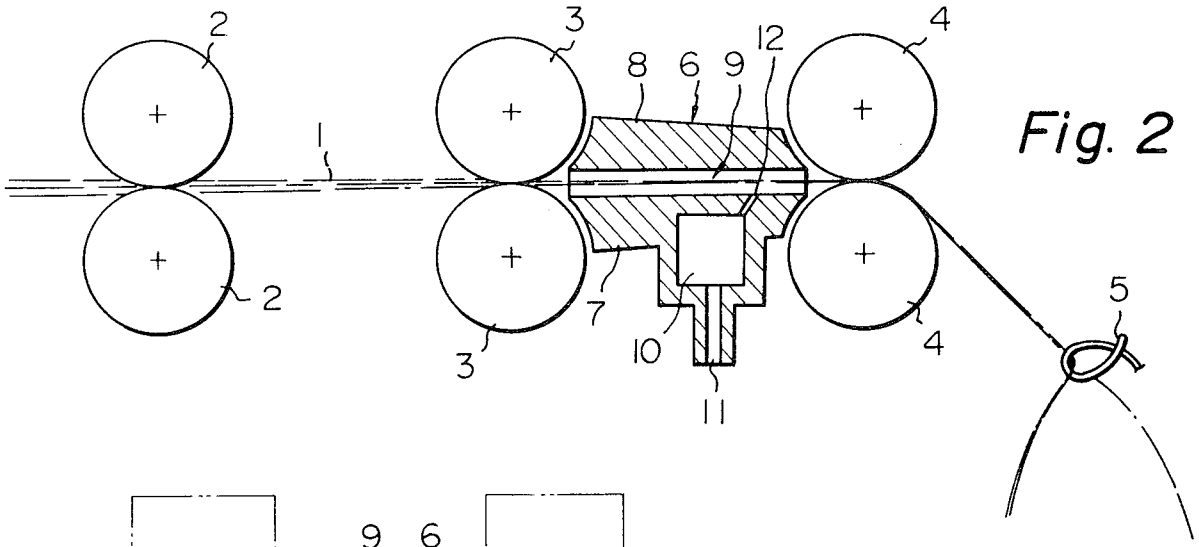
FIG. 2 is a sectional side view diagrammatically illustrating a first embodiment of the fiber strand drafting apparatus according to the present invention.

The present invention is characterized in that a fiber strand guide device in a form of a tube is disposed instead of the above-mentioned aprons of the Casablanca system, as shown in FIG. 2. Since drafting action between the second back rollers and the front rollers is mainly described hereinafter, second back rollers 3 will be referred to as "back rollers 3" for simplification of the description in the instant specification.

Fiber strand guide device 6 consists of two parts; a body 7 and a lid 8, which form a lower and an upper portions of fiber strand guide device 6, respectively. Each of body 7 and lid 8 has a flat channel-like shape extending in the longitudinal direction, and when they are integrated, a passage 9 is formed through fiber strand guide device 6. A pressure adjusting chamber 10 is formed in the interior of body 7, and this chamber 10 is communicated with a compressed fluid source (not shown) through a port 11. Chamber 10 is also communicated with a slit-like jet 12 formed transversely on the bottom face of passage 9.

As shown in FIG. 2, the fiber strand guide device 6 is arranged midway between back rollers 3 and the front rollers 4 with such a positional relation that passage 9 coincides with the plane including the nip lines of back rollers 3 and front rollers 4, and open ends of the inlet and outlet of passage 9 confront the nip lines of back rollers 3 and front rollers 4, respectively.

The section in the lateral direction of passage 9, that is, the section of passage 9 along the plane parallel to the plane including the rotational axes of the front rollers 4,4, has such a rectangular shape that the height is smaller than the width. Jet 12 is formed on the bottom face of the inner wall in the form of a slit along the entire width, and is inclined forwardly toward the running direction of the fiber strand delivered in the passage 9 so that an extension line of jet 12 intersects the fiber strand.

Figure 3:
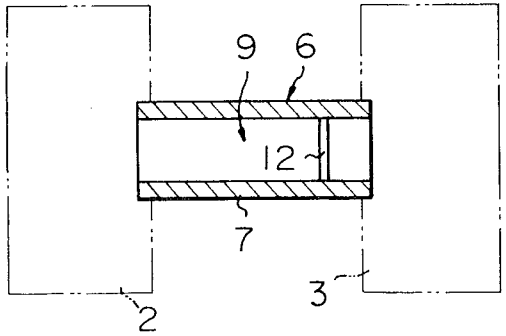
FIG. 3 is a sectional plan view illustrating the main part of the apparatus shown in FIG. 1.

As is clearly shown in FIG. 3, in the section of fiber strand guide device 6 along the plane including both the nip lines, passage 9 has a long rectangular shape.

The operation of fiber strand guide device 6 having the above-mentioned structure will now be described.

A fiber strand 1 introduced into fiber strand guide device 6 is in the form of being spread flatly in the lateral direction by the gripping force between back rollers 3,3. Fiber strand 1 receives on one side of spread surface thereof an action of a fluid stream jetted in the form of a thin layer from jet 12 while fiber strand 1 runs through passage 9 of fiber strand guide device 6 between the rollers 3 and 4. The force produced by this fluid stream has a component guiding fiber strand 1 in the running direction and a component guiding fiber strand 1 toward the inner wall of passage 9 confronting jet 12. Since the height of passage 9 is small as pointed out hereinbefore, the fiber strand is pressed onto the inner wall by the latter component of the force. If a certain momentary state of fiber strand 1 being drafted is examined, it is seen that fibers having one ends nipped by front rollers 4,4 run at the same speed as the peripheral speed of the front rollers 4, while fibers having one ends still nipped by back rollers 3,3 run at a lower speed, and floating fibers in question, which are not nipped by either back rollers 3 or front rollers 4, are influenced by the behaviors of the above-mentioned two groups of fibers and are likely to make unstable motions, with the result that the drafting action is readily disturbed. In the present invention, however, since the intermediate portion of the fiber strand is pressed onto the inner wall of passage 9 by the action of the fluid stream as described above, a frictional force is produced between the fiber strand and the inner wall of passage 9, and free movements of floating fibers are controlled. Furthermore, the intermediate portion of the fiber strand as a whole is accelerated by the component of the force of the fluid stream and is forwarded to the nip zone of the front rollers 4,4 in this accelerated state. Accordingly, an abrupt change of the speed of the floating fibers is avoided, with the result that attainment of a uniform drafting action can be expected.

In the present first embodiment, since jet 12 is formed as a fine slit extending transversely of passage 9, a uniform thin layer-like fluid stream is formed along the entire width of passage 9 and uniform pressing and forwarding forces are applied to the fiber strand.

As pointed out hereinbefore, jet 12 is slanted forwardly with respect to the running direction of the fiber strand 1, and it is preferred that jet 12 be inclined at an angle of less than 85°, especially 60° to 80°, with respect to the axial line of passage 9 directed to the upstream side. If this inclination angle is adopted, a well-balanced pressing action and advancing action can be produced.

Figure 7:
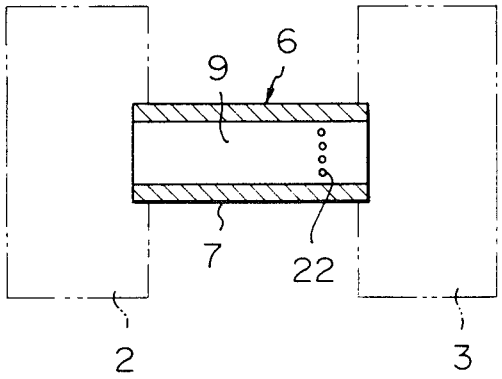
FIG. 7 is a sectional plan view illustrating an example of the jet hole.

In view of the principle of the present invention, it is obvious that the position of formation of jet 12 in passage 9 is not particularly critical, so far as jet 12 is formed on the inner wall confronting the spread face of fiber strand 1. However, it is preferred that the fluid stream be caused to act on the front roller side ends of the floating fibers for avoiding bending thereof. Therefore, it is preferred that jet 12 be formed at a position deviated downstream from the center of passage 9 (for example, as shown in FIGS. 1 and 2). Especially, if jet 12 is formed in the vicinity of the outlet end of passage 9, the accelerating effect to the floating fibers is enhanced, and the speed of the floating fibers can be elevated to a level of the speed of the front rollers and the floating fiber run to the nip point at this increased speed. Accordingly, it is most preferred that jet 12 be formed in the vicinity of the outlet end of passage 9. A plurality of jets may be formed at positions along passage 9, instead of the above-mentioned single jet 12. Moreover, a jet comprising small-diameter circular holes 22 arranged in a line, as shown in FIG. 7, may be used instead of the slit-like jet 12.

If the pressure of the fluid to be supplied to jet 12 is too high, the fiber strand is disturbed and the spinning operation is adversely influenced, and, on the other hand, if this pressure is too low, the intended pressing and contacting effect cannot be attained. Accordingly, it is preferred that the pressure of the fluid be lower than 0.1 $Kg/cm^2$, especially 0.01 to 0.06 $Kg/cm^2$.

In view of the ease of handling easiness and the maintenance of a good working environment, air is the most preferred fluid. Steam may be added to air in the midway of the air supply passage. Conditioned air having a relative humidity of at least 80% reduces the friction coefficient between the fibers in certain cases, and the drafting operation can be performed very smoothly. In this case, it is preferred that jet 12 be disposed at a position deviated upperstream from the center.

An example of the results the spinning operation performed by using the above-mentioned fiber guide device of the first embodiment will now be described.

EXPERIMENTAL EXAMPLE

1. Spun yarn: 40S composed solely of polyester staple fibers.

Delivery speed: 140 m/min

Fluid used: air alone

The obtained results are as follows.

| | Drafting Apparatus | | |
|---|---|---|---|
| | Present Invention | Casablanca System | Drafting by Rollers Alone |
| U % of Spun Yarn | 13.8 | 13.2 | 28.0 |

The quality of the yarn obtained according to the present invention was comparable to the quality of the yarn obtained according to the Casablanca system.

2. If the operation is carried out according to the present invention under the conditions as described above except that water is incorporated at a rate of 10 $cc/m^3$ into air used as the fluid, the U % value of the obtained yarn is 10.5.

Figure 4:
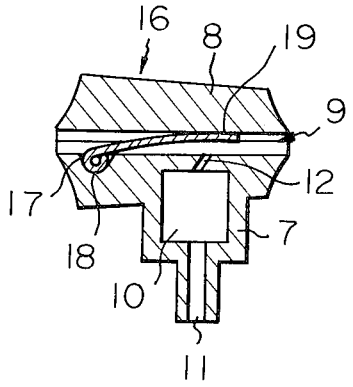
FIG. 4 is a sectional side view illustrating a second embodiment of the draft control apparatus according to the present invention.

FIG. 4 illustrates a fiber strand guide device 16 of the second embodiment according to the present invention. Device 16 is different from the first embodiment in the point where a pressure plate 19 is attached. More specifically, in the present second embodiment, a groove 17 extending in the lateral direction is formed on the inner wall of a passage 9 having the same structure as that of passage 9 in the first embodiment. In groove 17, a shaft 18 secured at an end of an arcuate pressure plate 19 formed of a thin spring member is pivoted so that pressure plate 19 is freely turned in the direction of the height of passage 9 around shaft 18. Pressure plate 19 extends from shaft 18 toward the upstream side in passage 9 and the front portion of pressure plate 19 is formed as a free end confronting jet 12. Accordingly, the jetted fluid stream impinges against the lower surface of pressure plate 19 and the free end of the pressure plate 19 is pressed onto the inner wall of passage 9 on the side confronting the opening of jet 12.

At the step of drafting a fiber strand, the intermediate portion of the fiber strand is advanced, the middle portion thereof being kept between the inner wall of passage 9 and pressure plate 19, as described above, by the action of the fluid stream. Accordingly, motions of the floating fibers are controlled. The fluid stream which impinges against pressure plate 19 is forwardly turned along the lower surface of pressure plate 19 and exerts a dragging action to fiber strand 1.

In the present second embodiment, pressure plate 19 may be originally pre-stressed to assist the pressing force of the fluid stream directed to the inner wall of passage 9. In this case, pressure plate 19 is not turnably arranged but is fixed to groove 17.

The second embodiment is advantageous because all the fluid stream is utilized for advancing the fiber strand.

Figure 5:
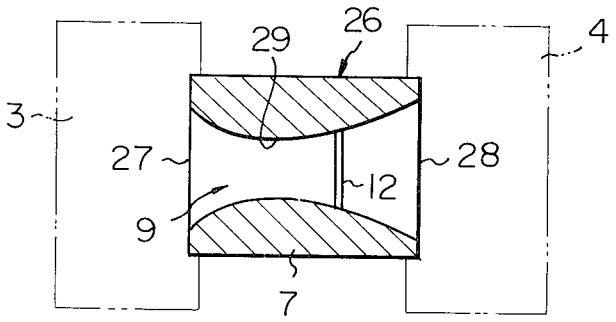
FIG. 5 is a partially sectional plan view illustrating a third embodiment of the apparatus according to the present invention.
Figure 6:
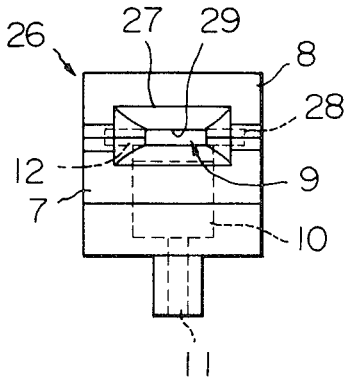
FIG. 6 is a back view illustrating the apparatus shown in FIG. 5.

The third embodiment of the present invention is illustrated in FIGS. 5 and 6. In this embodiment, the shape of passage 9 is not so simple as in the first and second embodiments but as is seen from the plan view of FIG. 5, passage 9 has such a special shape that the central portion is narrowed and the inlet and outlet portions are expanded. This embodiment is especially suitable for spinning of a fasciated yarn.

The shape of passage 9 of the third embodiment will now be described in detail. The width and height are most diminished substantially at the center 29 in the longitudinal direction of passage 9, and the width and height are gradually expanded toward the upstream side to an inlet end 27 and only the width is gradually expanded toward the downstream side to an outlet end 28 while the height is kept constant. Accordingly, outlet end 28 has a very flat rectangular sectional shape. Jet 12 for jetting a fluid has the same shape and structure as in the first and second embodiments, and jet 12 is disposed between central portion 29 and outlet end 28. Both the side portions of jet 12 are outwardly inclined so that the jetted fluid stream is expanded and spread.

In spinning of a fasciated yarn, it is preferred that a fiber strand be false-twisted in the state where fibers on both the edge portions of the fiber strand are not restricted by fibers of the core portion, whereby fasciation is caused by entanglement of free fibers on both the edge portions with the fibers of the core portion in the untwisting zone. Accordingly, it is necessary that the fiber strand should be delivered from the drafting apparatus to the false twisting nozzle in the state where the fiber strand is in the ribbon-like form having a broad width. In the present third embodiment, inlet end 27 of the passage 9 is broadened and expanded in the funnel-like form. Accordingly, even if fiber strand 1 is thick, fiber strand 1 can be introduced into passage 9 very smoothly, and as fiber strand 1 once narrowed in central portion 29 of passage 9 runs to the downstream side, the fiber strand is gradually expanded by dint of the shape of passage 9 and by the action of the fluid stream to form a desirable ribbon uniform in the thickness. Accordingly, the fibers of both the edge portions can effectively be disposed further from the fibers of the core portion. Furthermore, since floating fibers are well-controlled by pressing onto the inner wall of passage 9 by the fluid stream jetted from jet 12, fasciated yarns of broader count number range can be produced very conveniently. Of course, in the present third embodiment, the above-mentioned pressure plate of the second embodiment may be used. In this case, the pressure plate is formed to have a shape in accordance with the shape of passage 9.

The fourth embodiment of the present invention is suitable as a drafting apparatus of a ring spinning frame, though this embodiment is not specifically illustrated in the accompanying drawings. In contrast to the case of the above-mentioned fasciated yarn spinning machine, in case of a ring spinning frame, it is preferred that the width of a fiber strand delivered from the drafting apparatus be as narrow as possible. Accordingly, in the fiber strand guide device of the fourth embodiment, the passage is formed so that the section of the passage has a rectangular shape having a low flatness degree, an oval shape, a circular shape or other appropriate shape, and it is preferred that the jet be formed not only on the bottom surface of the inner wall of the passage but also on the side surface of the passage. By the fluid stream jetted from the jet formed on the side surface, the main stream is converged downstream to the axis of the passage whereby expansion of the fiber strand is prevented.

As will be apparent from the foregoing description, according to the present invention, the fiber strand delivered from the back rollers to the front rollers is guided into the passage defined by the tubular inner wall of the fiber strand guide device disposed between the back rollers and the front rollers, and in this passage, the fluid stream having a component of force acting in the running direction of the fiber strand and a component of force pressing the fiber strand onto the inner wall is caused to act on the spread face of the fiber strand. Accordingly, random motions of floating fibers are controlled and the drafting operation can be performed smoothly in a good condition. Furthermore, when the pressure plate is used, the above effect of the fluid stream can be enhanced.

In the present invention, relatively weak and brittle members moved at a high speed, such as aprons used in the drafting apparatus of the Casablanca system, are unnecessary. Accordingly, stopping of the operation due to breakage of these members or for repairing these members is avoided, and the present invention is effectively applied to spinning of a fasciated yarn which requires a high-speed operation.

Furthermore, since the fiber strand can be pressed and controlled at an optional position by the fluid stream, the roller gauge between the drafting rollers, which is very critical to perform an uniform draft in the conventional drafting devices, can be increased irrespectively of the fiber length of the staples composed of the fiber strand. This enables utilization of the drafting rollers having larger diameters which are suitable for high speed processing.

We claim:

1. An apparatus for drafting fiber strands, which comprises a pair of back rollers and a pair of front rollers, which are arranged separately from each other with a certain distance therebetween in parallel to each other, wherein a fiber strand delivered from the back rollers to the front rollers in the state nipped by the respective pairs of the rollers is drafted by the difference of the peripheral speed between the back rollers and the front rollers, said drafting apparatus being characterized in that a fiber strand guide device having a passage defined by a tubular inner wall is disposed in the drafting zone and jet means extending laterally across substantially the entire width of said passage for forming a fluid stream inclined toward the running direction of the fiber strand and intersecting the running direction of the fiber strand is arranged on a part of the passage.

2. A drafting apparatus as set forth in claim 1, wherein the section of said passage in the plane parallel to the plane including the axes of the pair of the front rollers has a rectangular shape having longer sides in the axial directions of the front rollers or an oval shape similar thereto.

3. A drafting apparatus as set forth in claim 1 or 2, wherein said jet means comprises a jet formed along the entire long side of a rectangular or oval section of said passage and a pressure adjusting chamber connected to said jet, and said pressure adjusting chamber is connected to a compressed fluid source.

4. A drafting apparatus as set forth in claim 3, wherein said jet is a slit.

5. A drafting apparatus as set forth in claim 3, wherein said jet comprises a plurality of small holes arranged in a line.

6. A drafting apparatus as set forth in claim 1, wherein the section of said passage in the plane parallel to the plane including the nip line between the pair of the front rollers and the nip line between the pair of the back rollers has a minimum width in the central portion, the width of said section is gradually increased to both the upstream and downstream sides and the height of the section of said passage in the plane intersecting the axes of the pair of the front rollers at a right angle is gradually increased to the upstream side from said minimum width portion while said height is kept constant on the downstream side, so that the outlet end of the passage on the downstream side has a flat rectangular shape having a broad width.

7. A drafting apparatus as set forth in claim 6, wherein the fluid stream is inclined in such a direction that the fluid stream is spread in the lateral direction of said passage toward the downstream side.

8. A drafting apparatus as set forth in claim 6, wherein the jet is inclined in such a direction that a fluid stream converges to the downstream side.

9. A drafting apparatus as set forth in claim 1, wherein a pressure plate having a free end on the downstream side and the other end secured to said passage is disposed in said passage to confront said jet.

10. A method for drafting fiber strands, which comprises delivering a fiber strand while nipping the fiber strand by a pair of back rollers and a pair of front rollers rotated at a speed higher than the speed of the back rollers and drafting the fiber strand by utilizing the difference of the peripheral speed between the back rollers and the front rollers, said drafting method being characterized in that a fiber strand passage defined by a tubular inner wall is formed between the back rollers and the front rollers, a fluid stream having a component of force acting in the running direction of the fiber strand is jetted from a part of said passage to act on the fiber strand, and the fiber strand is pressed onto a part of the inner wall of said passage, whereby floating fibers in the fiber strand are controlled by a frictional force between the fiber strand and the inner wall of said passage.

11. A drafting method according to claim 10, wherein a force pressing the fiber strand to a part of said passage is given, together with said force component acting in the running direction of the fiber strand, by a fluid stream intersecting at an acute angle the upstream side of the running direction of the fiber strand passage.

12. A drafting method according to claim 10, wherein the force pressing the fiber strand to a part of said passage is given by a pressure plate disposed in said passage.

13. A drafting method according to any of claims 10 through 12, wherein the fiber strand is spread in the lateral direction toward the downstream side by the fluid stream.

14. A drafting method according to claim 10, wherein the fiber strand is converged in the axial direction toward the downstream side by the fluid stream.

15. Apparatus for drafting fiber strands, comprising:

a pair of adjacent back rollers having their axes arranged along a first line;

a pair of adjacent front rollers spaced apart from and disposed downstream of said back rollers, said front rollers having their axes arranged along a second line parallel to said first line;

said pairs of rollers being arranged so that a fiber strand delivered from the back rollers to the front rollers is nipped by each pair of rollers and is drafted according to the difference in peripheral speed between the back rollers and the front rollers;

a fiber strand guide device for guiding said strand, said guide device being disposed along the path of said strand in the drafting zone between the back and front rollers, said guide device having a longitudinal passage aligned with the direction of travel of said strand between said back and front rollers, said passage having an entrance end for receiving said strand from said rear rollers and an exit end for delivering said strand to said front rollers, said passage having an elongated cross-section with a relatively small height in the direction of said first and second lines and a relatively large width in the direction parallel to the axes of said rollers, said passage having two juxtaposed relatively long transverse wall portions defining the width thereof and two juxtaposed relatively short transverse wall portions defining the height thereof; and jet means communicating with said passage at an acute angle along substantially the entire width of one of said relatively long transverse wall portions, for directing a fluid stream toward said front rollers and the other of said relatively long transverse wall portions, and obliquely to the longitudinal direction of said passage, said jet means being disposed relatively proximate to the exit end of said guide device and relatively remote from the entrance end thereof, said jet means being configured to apply to said strand a force having a first component urging said strand toward said front rollers, and a second component urging said strand toward said other relatively long transverse wall portion of said passage, so that said strand, along its entire width, may be pressed against and guided by said other relatively long transverse wall portion of said passage, while floating fibers associated with said strand are simultaneously accelerated toward said front rollers.

* * * * *